US005564938A

United States Patent [19]

Shenkal et al.

[11] Patent Number: 5,564,938

[45] Date of Patent: Oct. 15, 1996

[54] LOCK DEVICE FOR USE WITH COAXIAL CABLE CONNECTION

[76] Inventors: Yuval Shenkal, 6540 Lusk Blvd., Ste. C-254, San Diego, Calif. 92121; Joseph Neustein, 10201 Gateway West. Ste. 201, El Paso, Tex. 79925

[21] Appl. No.: 384,255

[22] Filed: Feb. 6, 1995

[51] Int. Cl.[6] ..... H01R 13/44; H01R 13/625

[52] U.S. Cl. ..... 439/301; 439/133; 439/306

[58] Field of Search ..... 439/133, 304, 439/306–309, 301, 302, 578, 583, 584, 579

[56] References Cited

U.S. PATENT DOCUMENTS

| | | | |
|---|---|---|---|
| 3,519,979 | 7/1970 | Bodenstein | 439/133 |
| 3,573,702 | 4/1971 | O'Keefe | 338/220 |
| 3,861,770 | 1/1975 | Horak | 439/133 |
| 3,890,028 | 6/1975 | Blanchenot | 439/133 |
| 4,163,594 | 8/1979 | Aujla | 439/133 |
| 4,168,921 | 9/1979 | Blanchard | 403/19 |
| 4,469,386 | 9/1984 | Ackerman | 339/37 |
| 4,557,546 | 10/1985 | Preger | 439/320 |
| 4,750,898 | 6/1988 | Soulard | 439/301 |
| 4,932,874 | 6/1990 | Hollopeter | 439/133 |
| 5,002,503 | 3/1991 | Campbell et al. | 439/578 |
| 5,106,312 | 4/1992 | Yeh | 439/133 |
| 5,273,444 | 12/1993 | Down et al. | 439/133 |

*Primary Examiner*—Hien D. Vu
*Attorney, Agent, or Firm*—John R. Flanagan

[57] ABSTRACT

A lock device for use with a coaxial cable connection includes an annular inner member and a annular outer sleeve. The inner member has an end portion with threads for engaging the inner member on a male coaxial cable connector part extending from a television or other device. The outer sleeve is inserted over and slid back along a coaxial cable terminating in a female coaxial cable connector part allowing the cable to be connected to the television or other device by the installer's fingers or standard tools such as pliers. The sleeve then is slid forward along the coaxial cable and over the inner member until the outer sleeve covers the inner member and the coaxial cable connection and one of a series of notches on the inside of the sleeve engages a flange on the outside of the inner member. Engagement of one of the series of notches with the flange locks the sleeve over the inner member and the coaxial cable connection thereby preventing an unauthorized person from disconnecting the coaxial cable from the television or other device.

19 Claims, 1 Drawing Sheet

LOCK DEVICE FOR USE WITH COAXIAL CABLE CONNECTION

BACKGROUND OF THE INVENTION

1. Field of the Invention

The present invention generally relates to coaxial cable connectors and, more particularly, is concerned with a lock device for inhibiting or preventing disconnection of a coaxial cable from the back of a television or other device.

2. Description of the Prior Art

Televisions and other devices often have male connector parts that may be connected to a coaxial cable terminating with a complementary female connector part thereby allowing the television or other device to receive a signal transmitted through the coaxial cable. To prevent the unauthorized use of the transmitted signal it is desirable to inhibit or prevent unauthorized persons from disconnecting the coaxial cable from the television or other device. It may also be desirable to inhibit or prevent children from disconnecting coaxial cables from televisions or other devices.

Several devices exist that are intended to inhibit or prevent tampering with coaxial cable connections. One device includes a termination unit and a locking shield that covers the termination unit. An example of this type of device is disclosed in U.S. Pat. No. 4,163,594 to Aujla. Because the termination unit in this type of device replaces the standard coaxial cable connector, this type of device has the drawback that it does not integrate with standard coaxial cable connections.

A second device includes a sleeve which prevents access to the coaxial cable connection and a hinged clamp which holds the sleeve in place. This type of device is disclosed in U.S. Pat. No. 4,750,898 to Soulard. While this type of device has the advantage that it is intended to work with standard coaxial cable connections such as those found on computer equipment, it has the drawback of being more difficult to install than necessary since a screw that holds the clamp closed must be turned until the screw head breaks off.

A third device has a sleeve-like shield that surrounds the male and female parts of a coaxial cable connector and is open at one end permitting access for a special tool that is used to assemble and disassemble the connection. U.S. Pat. No. 4,168,921 to Blanchard discloses this type of device. The major drawback of this device is that the shield prevents the connection of the coaxial cable unless a special tool which fits through the open end of the shield is available.

Consequently, a need still exists for a device that inhibits or prevents disconnection of a coaxial cable from a television or other device and which integrates with standard coaxial cable connectors, is relatively simple to install and does not require the use of a special tool to connect the coaxial cable.

SUMMARY OF THE INVENTION

The present invention provides a lock device for use with a coaxial cable connector designed to satisfy the aforementioned needs by avoiding the drawbacks of the prior art without introducing other drawbacks. The present invention describes a two-part device having an inner member and an outer sleeve.

One advantage of the present invention is that it integrates with standard connectors used to connect coaxial cables to televisions or other devices. The inner member has threads for engaging it on the male connector part extending from a television or other device. The outer sleeve fits over and is locked onto the inner member. The sleeve covers the inner member and extends back along the coaxial cable covering the male and female connector parts thereby restricting access to the connection and inhibiting or preventing an unauthorized person from disconnecting the coaxial cable.

Another advantage of the present invention is the ease with which it may be installed. First the inner member is threaded onto the male connector part. Next, the coaxial cable terminating in a female connector part is pushed through the outer sleeve and connected to the male connector part. Finally, the outer sleeve is pushed over and onto the inner member causing notches within the outer sleeve to engage a flange on the outside of the inner member thereby making removal of the outer sleeve difficult if not impossible.

A further advantage of the present invention is that no special tool is needed to connect the coaxial cable when the device is installed. Before the outer sleeve is engaged on the inner member, the sleeve can be slid back along the coaxial cable. Thus, access to the male and female connector parts is not restricted during installation which allows the installer's fingers or standard tools such as pliers to be used when tightening the female connector part onto the male connector part.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
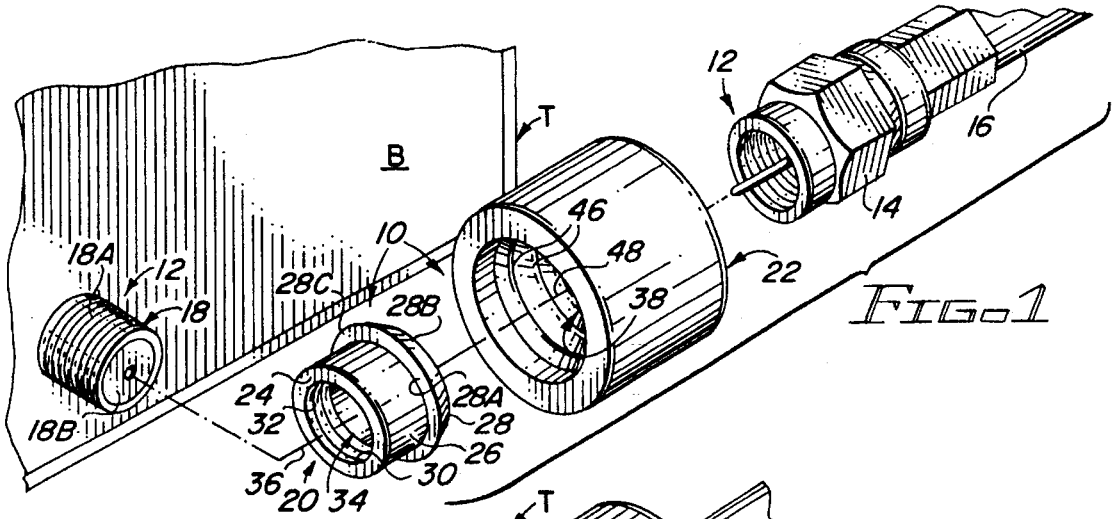
FIG. 1 is an exploded perspective view of a lock device of the present invention being shown with a coaxial cable connection extending from a television or other device.
Figure 2:
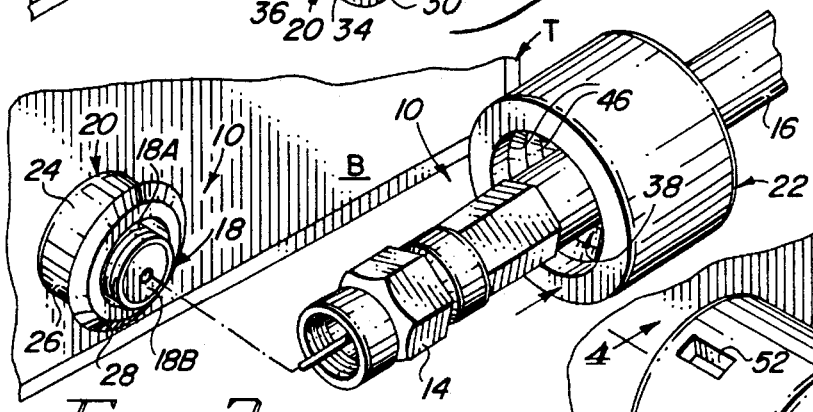
FIG. 2 is another exploded perspective view of the lock device showing an inner member of the lock device threaded onto a male connector part and an outer sleeve of the lock device inserted over a coaxial cable terminated with a female connector part.
Figure 3:
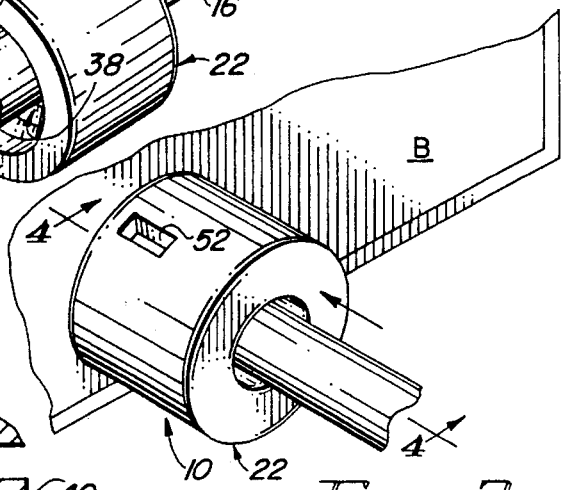
FIG. 3 is a perspective view of the lock device of the present invention applied over the coaxial cable connection.

Referring to the drawings and particularly to FIGS. 1–3, there is illustrated a lock device of the present invention, generally designated 10, adapted for use with a conventional coaxial cable connection, generally designated 12. The coaxial cable connection 12 has a female coaxial cable connector part 14 terminating one end of a conventional coaxial cable 16 and a male coaxial cable connector part 18 mounted to an electronic device, such as the back B of a conventional television T. The lock device 10 is adapted to inhibit or prevent disconnection of the female coaxial cable connector part 14 the male coaxial cable connector part 18.

Figure 4:
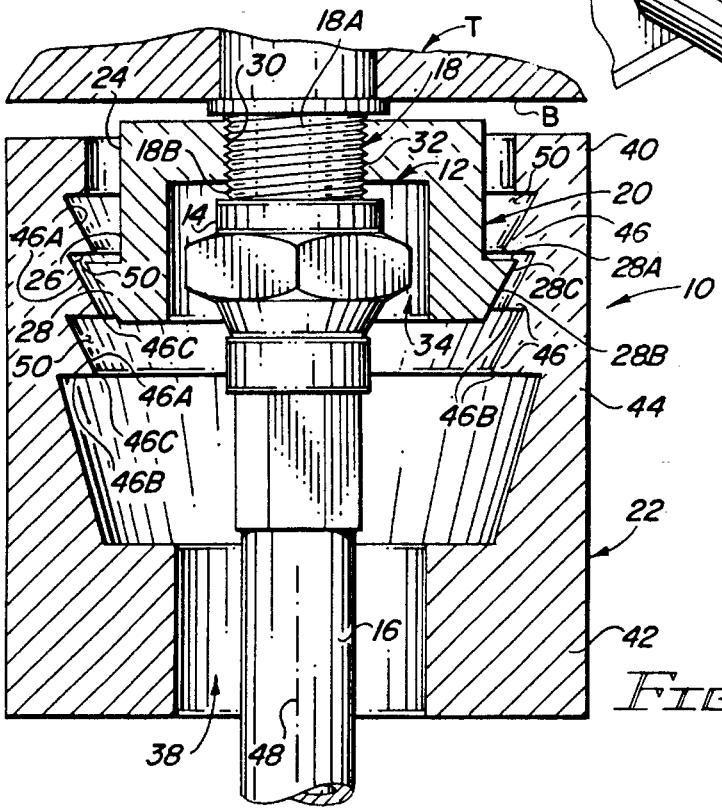
FIG. 4 is an enlarged axial sectional view of the applied lock device taken along line 4—4 of FIG. 3.

Referring to FIGS. 1, 2 and 4, the lock device 10 of the present invention basically includes an inner annular member 20 and an outer annular sleeve 22, both preferably having cylindrical configurations. The inner member 20 of the lock device 10 has an annular first end portion 24, an annular second end portion 26, and an annular flange 28.

The first end portion 24 of the inner member 20 defines a central opening 30 having a section of internal threads 32 adapting the inner member 20 to be threaded over and onto a section of external threads 18A on the male connector part 18. The inner member 20 is threaded over the male connector part 18 to such an extent that an end 18B of the male connector part 18 extends through the central opening 30 and into a central bore 34 of the inner member 20.

The second end portion 26 of the inner member 20 is disposed opposite to and extend from the first end portion 24 and defines the central bore 34. The central bore 34 has a diameter and of an axial length such that the female connector part 14 may be disposed within the bore 34 and connected with the male connector part 18 after the inner member 20 is substantially threaded onto the male connector part 18.

The annular flange 28 of the inner member 20 is connected on and protruding radially outwardly from the outside of the inner member 20 on the end of the second end portion 26 thereof. The annular flange 28 includes a first annular surface 28A and a second opposite annular surface 28B. The first surface 28A faces toward the first end portion 24 of the inner member 20 and extends in a transverse relationship to a longitudinal central axis 36 of the central bore 34 of the inner member 20. The second surface 28B faces toward the second end portion 26 of the inner member 20 and extends in an outwardly inclined relationship away therefrom and relative to the central longitudinal axis 36 of the central bore 34 of the inner member 20.

Referring to FIGS. 1–4, the outer annular sleeve 22 of the lock device 10 has a central passageway 38 extending through the outer sleeve. Also, the outer sleeve 22 includes a first end portion 40, a second end portion 42 and an intermediate portion 44. The first end portion 40 defines a first portion of the central passageway 38 having a diameter greater than the diameter of the first and second end portions 24, 26 of the inner member 20 but less than the diameter of the annular flange 28. The second end portion 42 of the outer sleeve 22 is disposed opposite from the first end portion 40 of the outer sleeve 22 and defines a second portion of the central passageway 38 having a diameter less than the first and second end portions 24, 26 of the inner member 20 but great enough to allow insertion of the coaxial cable 16 terminated with the female connector part 14 through the central passageway 38. The intermediate portion 44 of the outer sleeve 22 is disposed between and connected to the first and second end portions 40, 42 and defines a middle portion of the central passageway 38.

As seen in FIG. 4, the intermediate portion 44 of the outer sleeve 22 has means for defining interiorly thereon at least one and preferably a plurality of positions which are mateable with the annular flange 28 on the inner member 20 to thereby lock the outer sleeve 22 on the inner member 20 when the outer sleeve 22 is pushed over the inner member 20, as shown in FIG. 3, and prevent the outer sleeve 22 from being slid back along the coaxial cable 16 away from the male connector part 18. The outer sleeve 22 has a length such that with the annular flange 28 is mated with a selected one of the successive positions, the outer sleeve 22 substantially covers the inner member 20 and the coaxial cable connection 12 thereby preventing access to the connection 12.

More particularly, the position defining means includes a series of annular teeth 46 formed in an axially-spaced relationship to one another on the intermediate portion 44 of the outer sleeve 22 along the middle portion of the central passageway 38. Each of the annular teeth 46 includes first and second opposite annular sides 46A, 46B. The first side 46A faces toward the first end portion 40 of the outer sleeve 22 and extends in an inwardly inclined relationship away therefrom and relative to a longitudinal central axis 48 of the central passageway 38 of the outer sleeve 22. The second side 46B faces toward the second end portion 42 of the outer sleeve 22 and extends in a transverse relationship to the central longitudinal axis 48 of the central passageway 38 of the outer sleeve 22.

The axially-spaced teeth 46 define therebetween a series of annular notches 50 which define the above-described successive positions engageable successively with the annular flange 28. Each successive notch 50 locks the outer sleeve 22 on the inner member 20 and prevents the outer sleeve 22 from being slid back along the coaxial cable 16. Each annular notch 50 has an inner diameter and an outer diameter. The annular flange 28 has an outer diameter slightly greater than the inner diameter of each annular notch 50 and less than the outer diameter of each annular notch 50. The diameter size of the end of the central passageway 38 at the first end portion 40 of the outer sleeve 22 and the inclined orientations of the first sides 46A of the teeth 46 and the inclined orientation of the second surface 28B of the annular flange 28 permit the outer sleeve 22 to be pushed over the inner member 20. However, the transverse orientations of the second sides 46B of the teeth and the transverse orientation of the first surface 28A of the annular flange 28 prevent the outer sleeve 22 from being pulled from the inner member 20. The inner member 20 and outer sleeve 22 are preferably made of a suitable material, such as a hard plastic for example polypropylene or nylon, which permits the tips 46C, 28C of the teeth 46 and of the flange 28 to yield slightly and allow insertion of the outer sleeve 22 over the inner member 20.

When the outer sleeve 22 is engaged over the inner member 20, the outer sleeve 22 covers both the inner member 20 and the coaxial cable connection 12. The second portion of the central passageway 38 defined by the second end portion 42 of the outer sleeve 22 is narrow enough to prevent access to the coaxial cable connection 12 by standard tools. Since the outer sleeve 22 cannot be slid back to expose the coaxial cable connection 12, an unauthorized person is prevented from easily disconnecting the coaxial cable 16 from the television or other device T.

Installation of the lock device 10 is done in three easy steps as shown in FIGS. 1, 2, and 3. First, the inner member 20 is threaded onto the male connector part 18. Second, the coaxial cable 16 with the female connector part 14 terminated thereon is pushed through the central passageway 38 of the outer sleeve 22 and threadably connected to the male connector part 18. Since the outer sleeve 22 can be slid back along the coaxial cable 16, connecting the female connector part 14 to the male connector part 18 can be accomplished without the use of special tools. Finally, after the coaxial cable connection 12 is made, the outer sleeve 22 is slid forward along the coaxial cable 12 and over the inner member 20 until the outer sleeve 22 covers the inner member 20 and one of the series of notches 48 engages the annular flange 28.

In order to remove the lock device 10, the outer sleeve 22 must be fractured to remove it from the inner member 22 and thus allow access to the female connector part 14. To facilitate fracturing of the outer sleeve 22, a detent 52 is provided in the exterior side of the outer sleeve 22 for receiving the tip end of an ordinary screwdriver to use in applying the necessary force to fracture the outer sleeve 22.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A lock device for use with a coaxial cable connection having a female coaxial cable connector part attached to one end of a coaxial cable and a male coaxial cable connector part mounted to and extending from a device, comprising:

(a) an inner annular member including (i) a first end portion having internal threads to screw said inner member onto the male coaxial cable connector part, (ii) a second end portion opposite said first end portion having a central bore extending partially into said inner member, said bore being of a diameter and of a depth such that the female coaxial cable connector part is disposed within said bore and connected with the male coaxial cable connector part after said inner member is substantially screwed onto the male coaxial cable connector part, and (iii) an annular flange integrally formed on and protruding radially outward from an outside of an edge of said inner member; and (b) an outer annular sleeve having a central passageway extending through said outer sleeve, said outer sleeve including (i) a first end portion defining a first portion of said central passageway having a diameter greater than a diameter of said inner member but less than a diameter of said flange;

(ii) a second end portion opposite said first end portion defining a second portion of said central passageway having a diameter less than said inner member but great enough to allow insertion of the coaxial cable terminated with the female coaxial cable connector part through said central passageway, and (iii) an intermediate portion between said first and second end portions defining a middle portion of said central passageway and having annular projection means for engaging with said flange to thereby lock said outer sleeve on said inner member and prevent said outer sleeve from being slid back along the coaxial cable away from the male coaxial cable connector part;

(c) said outer sleeve having a length such that with said flange engaging said annular projection means, said outer sleeve substantially covers entirely said inner member and the coaxial cable connection thereby preventing access to the coaxial cable connection.

2. The lock device of claim 1 wherein said annular projection means on said intermediate portion of said outer sleeve defines a plurality of successive positions, said flange of said inner member being engageable with said annular projection means at any selected one of said plurality of successive positions to thereby lock said outer sleeve on said inner member and prevent said outer sleeve from being slid back along the coaxial cable away from the male coaxial cable connector part.

3. The lock device of claim 2 wherein said annular projection means is a series of annular notches formed in an axially-spaced relationship to one another on said intermediate portion of said outer sleeve along said middle portion of said central passageway, said notches being engageable successively with said flange thereby locking said outer sleeve on said inner member and preventing said sleeve from being slid back along the coaxial cable.

4. The lock device of claim 3 wherein each of said annular notches has an inner diameter and an outer diameter, said annular flange having an outer diameter being greater than said inner diameter of each of said annular notches and being less than said outer diameter of each of said annular notches.

5. The lock device of claim 2 wherein said annular projection means is a series of annular teeth formed in an axially-spaced relationship to one another on said intermediate portion of said outer sleeve along said middle portion of said central passageway, said teeth being engageable successively with said flange thereby locking said outer sleeve on said inner member and preventing said sleeve from being slid back along the coaxial cable.

6. The lock device of claim 5 wherein each of said annular teeth includes:

a first side facing toward said first end portion of said outer sleeve and extending in an inwardly inclined relationship away therefrom and relative to a longitudinal axis of said central passageway of said outer sleeve; and a second side facing toward said second end portion of said outer sleeve and extending in a transverse relationship to said longitudinal axis of said central passageway of said outer sleeve.

7. The lock device of claim 1 wherein said flange on said inner member includes:

a first surface facing toward said first end portion of said inner member and extending in a transverse relationship to a longitudinal axis of said central bore of said inner member; and a second surface facing toward said second end portion of said inner member and extending in an inwardly inclined relationship away therefrom and relative to said longitudinal axis of said central bore of said inner member.

8. A lock device for use with a coaxial cable connection having a female coaxial cable connector part attached to one end of a coaxial cable and a male coaxial cable connector part mounted to and extending from a device, comprising:

(a) an inner annular member including (i) a first end portion having internal threads to screw said inner member onto the male coaxial cable connector part, (ii) a second end portion opposite said first end portion having a central bore extending-partially into said inner member, said bore being of a diameter and of a depth such that the female coaxial cable connector part is disposed within said bore and connected with the male coaxial cable connector part after said inner member is substantially screwed onto the male coaxial cable connector part, and (iii) an annular flange integrally formed on and protruding radially outward from an outside of an edge of said inner member; and (b) an outer annular sleeve having a central passageway extending through said outer sleeve, said outer sleeve including (i) a first end portion defining a first portion of said central passageway having a diameter greater than a diameter of said inner member but less than a diameter of said flange;

(ii) a second end portion opposite said first end portion defining a second portion of said central passageway having a diameter less than said inner member but great enough to allow insertion of the coaxial cable terminated with the female coaxial cable connector part through said central passageway, and (iii) an intermediate portion between said first and second end portions defining a middle portion of said central passageway and having annular projection means for engaging said flange of said inner member at any selected one of a plurality of successive positions to thereby lock said outer sleeve on said inner member and prevent said outer sleeve from being slid back along the coaxial cable away from the male coaxial cable connector part;

(c) said outer sleeve having a length such that with said flange engaged with said annular projection means in any selected one of said plurality of successive positions said outer sleeve substantially covers entirely said inner member and the coaxial cable connection thereby preventing access to the coaxial cable connection;

(d) said annular projection means of said intermediate portion of said outer sleeve being a series of annular notches formed in an axially-spaced relationship to one another on said intermediate portion of said outer sleeve along said middle portion of said central passageway, said notches being engageable successively with said flange thereby locking said outer sleeve on said inner member and preventing said sleeve from being slid back along the coaxial cable.

9. The lock device of claim 8 wherein each of said annular notches has an inner diameter and an outer diameter, said annular flange having an outer diameter being greater than said inner diameter of each of said annular notches and being less than said outer diameter of each of said annular notches.

10. The lock device of claim 8 wherein said series of annular notches is defined by a series of annular teeth formed in an axially-spaced relationship on said intermediate portion of said outer sleeve along said middle portion of said central passageway, said teeth being engageable successively with said flange thereby locking said outer sleeve on said inner member and preventing said sleeve from being slid back along the coaxial cable.

11. The lock device of claim 10 wherein each of said annular teeth includes:

a first side facing toward said first end portion of said outer sleeve and extending in an inwardly inclined relationship away therefrom and relative to a longitudinal axis of said central passageway of said outer sleeve; and a second side facing toward said second end portion of said outer sleeve and extending in a transverse relationship to said longitudinal axis of said central passageway of said outer sleeve.

12. The lock device of claim 11 wherein said annular flange on said inner member includes:

a first surface facing toward said first end portion of said inner member and extending in a transverse relationship to a longitudinal axis of said central bore of said inner member; and a second surface facing toward said second end portion of said inner member and extending in an inwardly inclined relationship away therefrom and relative to said longitudinal axis of said central bore of said inner member.

13. In combination with a lock device, a coaxial cable connection having a male coaxial cable connector part mounted to and extending from a device and a female coaxial cable connector part complementary to and engagable with said male coaxial cable connector part and attached to one end of a coaxial cable, said lock device comprising:

(a) an inner annular member including (i) a first end portion having internal threads, said inner member being screwed onto said male coaxial cable connector part, (ii) a second end portion opposite said first end portion having a central bore extending partially into said inner member, said bore being of a diameter and of a length such that said female coaxial cable connector part is disposed within said bore and connected with said male coaxial cable connector part after said inner member is substantially screwed onto said male coaxial cable connector part, and (iii) an annular flange integrally formed on and protruding radially outward from an outside of an edge of said inner member; and (b) an outer annular sleeve having a central passageway extending through said outer sleeve, said outer sleeve including (i) a first end portion defining a first portion of said central passageway having a diameter greater than a diameter of said inner member but less than a diameter of said flange;

(ii) a second end portion opposite said first end portion defining a second portion of said central passageway having a diameter less than said inner member but great enough to allow insertion of the coaxial cable terminated with said female coaxial cable connector part through said central passageway, and (iii) an intermediate portion between said first and second end portions defining a middle portion of said central passageway and having annular projection means for engaging said flange to thereby lock said outer sleeve on said inner member and prevent said outer sleeve from being slid back along the coaxial cable away from said male coaxial cable connector part;

(c) said outer sleeve having a length such that with said flange engaged with said annular projection means, said outer sleeve substantially covers entirely said inner member and said coaxial cable connection thereby preventing access to said coaxial cable connection.

14. The combination of claim 13 wherein said annular projection means of said intermediate portion of said outer sleeve defines a plurality of successive positions, said flange of said inner member being engageable with said annular projection means at any selected one of said plurality of successive positions to thereby lock said outer sleeve on said inner member and prevent said outer sleeve from being slid back along said coaxial cable away from said male coaxial cable connector part.

15. The combination of claim 14 wherein said annular projection is a series of annular notches formed in an axially-spaced relationship to one another on said intermediate portion of said outer sleeve along said middle portion of said central passageway, said notches being engageable successively with said flange thereby locking said outer sleeve on said inner member and preventing said sleeve from being slid back along the coaxial cable.

16. The combination of claim 15 wherein each of said annular notches has an inner diameter and an outer diameter, said annular flange having an outer diameter being greater than said inner diameter of each of said annular notches and being less than said outer diameter of each of said annular notches.

17. The combination of claim 14 wherein said annular projection means is a series of annular teeth formed in an axially-spaced relationship to one another on said intermediate portion of said outer sleeve along said middle portion of said central passageway, said teeth being engageable successively with said flange thereby locking said outer sleeve on said inner member and preventing said sleeve from being slid back along the coaxial cable.

18. The combination of claim 17 wherein each of said annular teeth includes:

a first side facing toward said first end portion of said outer sleeve and extending in an inwardly inclined relationship away therefrom and relative to a longitudinal axis of said central passageway of said outer sleeve; and a second side facing toward said second end portion of said outer sleeve and extending in a transverse relationship to said longitudinal axis of said central passageway of said outer sleeve.

19. The combination of claim 18 wherein said flange on said inner member includes:

a first surface facing toward said first end portion of said inner member and extending in a transverse relationship to a longitudinal axis of said central bore of said inner member; and a second surface facing toward said second end portion of said inner member and extending in an inwardly inclined relationship away therefrom and relative to said longitudinal axis of said central bore of said inner member.

* * * * *